US006787724B2

(12) United States Patent
Bennett et al.

(10) Patent No.: US 6,787,724 B2
(45) Date of Patent: Sep. 7, 2004

(54) SORTING MACHINE

(75) Inventors: William H. Bennett, Attica, MI (US); Christopher P. Hurttgam, Imlay City, MI (US)

(73) Assignee: Attica Automation, Rochester, MI (US)

( * ) Notice: Subject to any disclaimer, the term of this patent is extended or adjusted under 35 U.S.C. 154(b) by 102 days.

(21) Appl. No.: 10/226,441

(22) Filed: Aug. 23, 2002

(65) Prior Publication Data

US 2003/0201211 A1 Oct. 30, 2003

Related U.S. Application Data

(60) Provisional application No. 60/314,998, filed on Aug. 24, 2001.

(51) Int. Cl.[7] ..... B07C 5/12

(52) U.S. Cl. ..... 209/586; 209/929; 209/904; 209/907; 209/922; 209/923; 209/652; 198/690.1; 198/577

(58) Field of Search ..... 209/929, 939, 209/904, 907, 922, 923, 586, 652, 228, 576; 198/577, 690.1, 381

(56) References Cited

U.S. PATENT DOCUMENTS

| | | | | |
|---|---|---|---|---|
| 3,539,006 A | | 11/1970 | Hanna et al. | |
| 3,565,234 A | | 2/1971 | Birdsong | |
| 3,650,397 A | | 3/1972 | Bomemeier | |
| 3,709,328 A | * | 1/1973 | Moher et al. | 209/586 |
| 3,743,093 A | | 7/1973 | Klancnik | |
| 3,935,947 A | | 2/1976 | Barrett | |
| 3,983,388 A | * | 9/1976 | Gugliotta | 250/223 R |
| 4,125,191 A | | 11/1978 | Peace | |
| 4,174,028 A | * | 11/1979 | Barnes | 198/389 |
| 4,271,477 A | * | 6/1981 | Williams | 702/172 |
| 4,393,401 A | * | 7/1983 | Gorenflo et al. | 348/139 |
| 4,457,622 A | * | 7/1984 | Kato et al. | 209/586 |
| 4,557,125 A | * | 12/1985 | Schaumburg | 72/18.6 |
| 4,784,493 A | * | 11/1988 | Turcheck et al. | 356/394 |
| 4,823,396 A | * | 4/1989 | Thompson | 382/152 |
| 4,842,890 A | | 6/1989 | Sessa et al. | |
| 4,875,776 A | * | 10/1989 | Pryor | 356/625 |
| 4,877,138 A | * | 10/1989 | Motiwala | 209/601 |
| 4,905,842 A | * | 3/1990 | Habele et al. | 209/557 |
| 5,047,851 A | * | 9/1991 | Sauerwein et al. | 382/149 |
| 5,078,083 A | | 1/1992 | DiMaio et al. | |
| 5,114,230 A | * | 5/1992 | Pryor | 356/625 |
| 5,139,150 A | * | 8/1992 | Fuller et al. | 209/576 |

(List continued on next page.)

FOREIGN PATENT DOCUMENTS

EP 85124 A1 * 8/1983 ..... B07C/05/36

*Primary Examiner*—Donald P. Walsh
*Assistant Examiner*—M. Kohner
(74) *Attorney, Agent, or Firm*—Reising, Ethington, Barnes, Kisselle, P.C.

(57) ABSTRACT

A sorting machine receives a bulk of workpieces or fasteners from a hopper unit into a feed station which align the fasteners into a single file for engagement to a transport system of an inspection station. Preferably, the transport system has a conveyor belt with a magnetic member disposed radially inward from the belt. The fasteners are preferably ferrous and thereby engage the conveyor belt via the magnetic field which penetrates the belt. The fasteners are thus carried along the transport system past a trigger sensor which sends a signal to a central controller to timely actuate a dimensional sensing apparatus which takes an image of the fastener and sends it to the central computer for dimensional analysis. If the fastener fails to meet pre-established guidelines the nonconforming fastener is ejected from the transport system via a reject mechanism. If the fastener conforms, it continues to move along the transport system, past a counter sensor and is then dropped off the conveyor belt of the transport system into a packaging station for ultimate delivery to the customer.

20 Claims, 8 Drawing Sheets

U.S. PATENT DOCUMENTS 5,147,047 A * 9/1992 Ahmed et al. ..... 209/538
5,158,181 A * 10/1992 Bailey ..... 209/558
5,197,607 A * 3/1993 Hakansson ..... 209/586
5,213,218 A * 5/1993 DiGrande et al. ..... 209/539
5,440,396 A * 8/1995 Markus et al. ..... 356/394
5,476,689 A 12/1995 Stone et al.
5,511,670 A * 4/1996 Demarest et al. ..... 209/540
5,703,784 A * 12/1997 Pearson ..... 700/223
5,817,177 A 10/1998 Wallace
5,823,356 A * 10/1998 Goodrich et al. ..... 209/601
6,004,627 A 12/1999 Duffy et al.
6,088,111 A * 7/2000 Ciani et al. ..... 356/634
6,156,392 A 12/2000 Duffy et al.
6,380,503 B1 * 4/2002 Mills et al. ..... 209/586

* cited by examiner

SORTING MACHINE

CROSS-REFERENCE TO RELATED APPLICATION

This application claims priority of U.S. Provisional Application No. 60/314,998, filed Aug. 24, 2001, entitled "Sorting Machine."

TECHNICAL FIELD

The present invention relates to a workpiece sorting machine and more particularly to an automated workpiece sorting, dimensional inspection and segregation machine for fasteners.

BACKGROUND OF THE INVENTION

With increasing world-wide competition in manufacturing, reducing production costs while maintaining, if not improving, quality of the manufactured workpiece is paramount. When the workpiece is manufactured in large quantities, unique challenges in the manufacturing process are presented. For instance, the manufacturing of a fastener or threaded bolt as the workpiece requires dimensional inspection of each bolt which may not be visible to the naked eye. Moreover, to accomplish inspection, the fasteners or bolts must be arranged in an orderly fashion. Fasteners which do not meet pre-established quality guidelines must also be segregated from the remaining fasteners which are ultimately counted and delivered to the customer. Preferably, and as a cost cutting measure, the segregated rejected fasteners are recycled.

Within an assembly line operation, manual operator arrangement of hundreds, if not thousands, of fasteners is cost prohibitive. Likewise, manual inspection of many different types of workpieces or fasteners may lead to operator error, may not be possible due to sight limitations of the naked eye, or simply may not be possible due to the speed in which the fasteners pass along the assembly line.

SUMMARY OF THE INVENTION

A sorting machine receives a bulk of workpieces or fasteners from a hopper unit into a feed station which align the fasteners into a single file for engagement to a transport system of an inspection station. Preferably, the transport system has a conveyor belt with a magnetic member disposed radially inward from the belt. The fasteners are preferably ferrous and thereby engage the conveyor belt via the magnetic field which penetrates the belt. The fasteners are thus carried along the transport system past a trigger sensor which sends a signal to a central controller to timely actuate a dimensional sensing apparatus which takes an image of the fastener and sends it to the central computer for dimensional analysis. If the fastener fails to meet pre-established guidelines the nonconforming fastener is ejected from the transport system via a reject mechanism. If the fastener conforms, it continues to move along the transport system, past a counter sensor and is then dropped off the conveyor belt of the transport system into a packaging station for ultimate delivery to the customer.

Advantages of the present invention include an automated inspection and sorting machine capable of improving quality of a manufactured workpiece, reducing required manpower, increased speed and efficiency of manufacturing, and is a robust and relatively inexpensive and user friendly design.

BRIEF DESCRIPTION OF THE DRAWINGS

The presently preferred embodiments of the invention are disclosed in the following description and in the accompanying drawings, wherein.

DETAILED DESCRIPTION OF THE PREFERRED EMBODIMENTS

Figure 1:
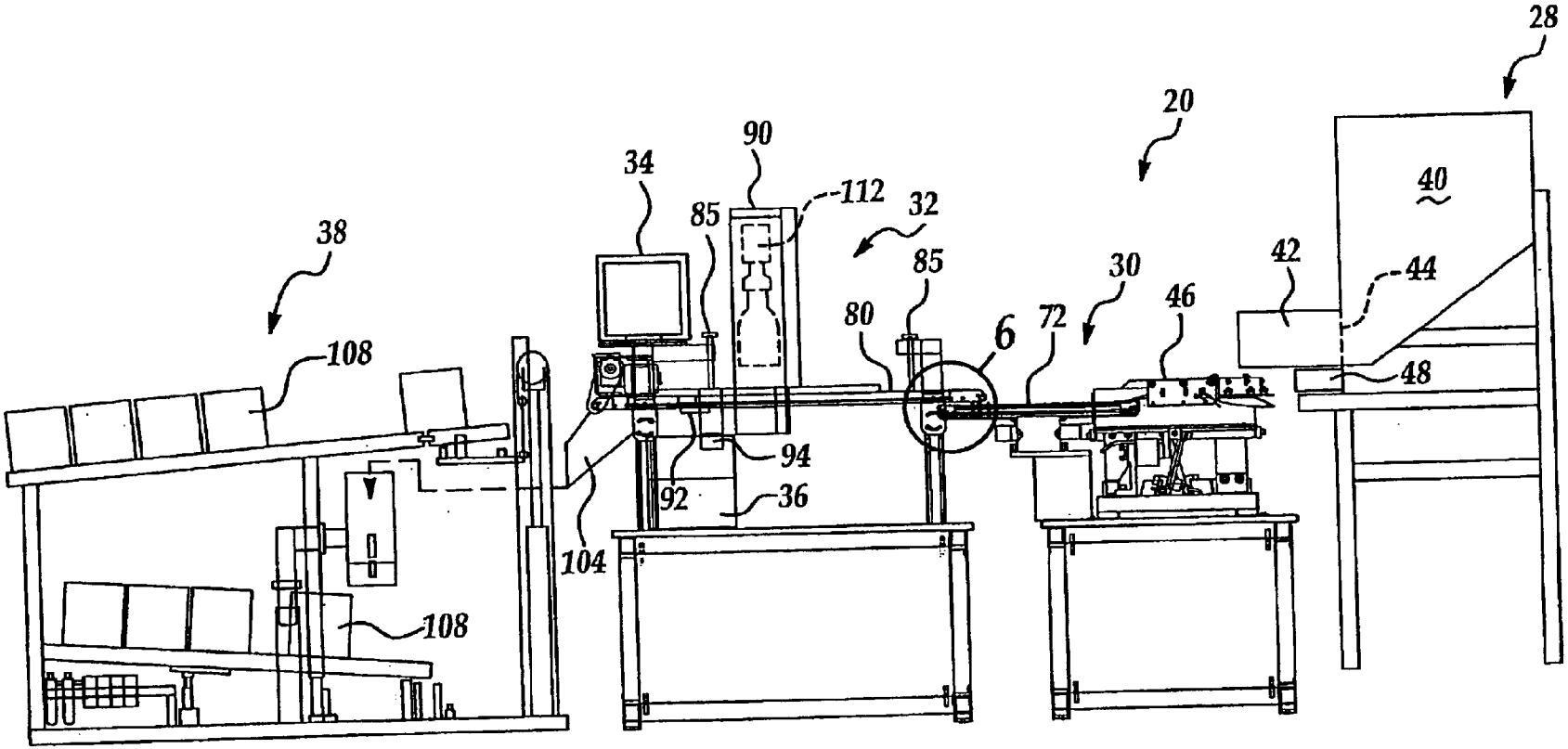
FIG. 1 is a side view of a sorting machine of the present invention.
Figure 2:
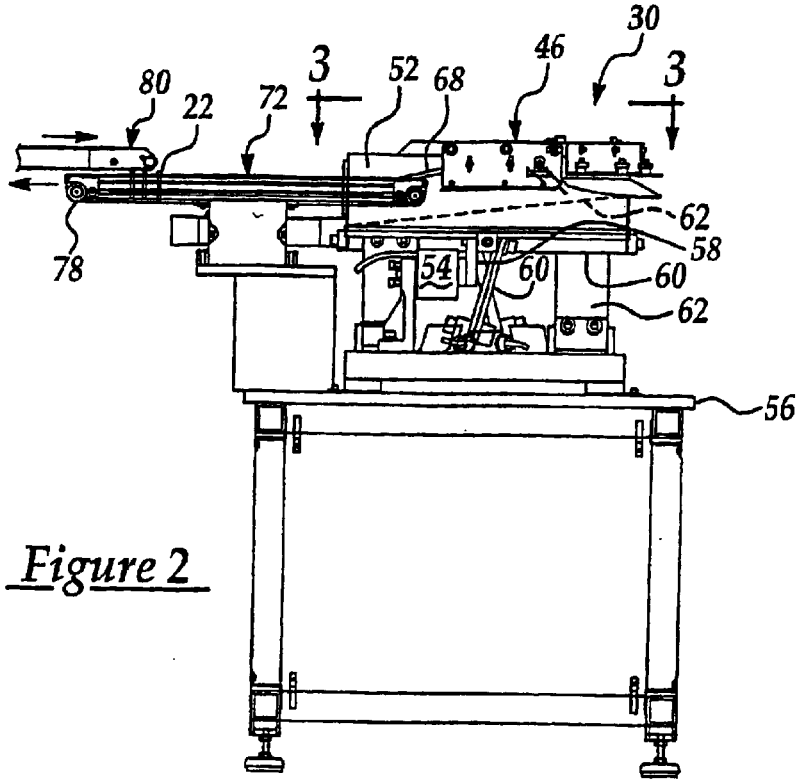
FIG. 2 is a side view of a feeder station of the sorting machine.
Figure 3:
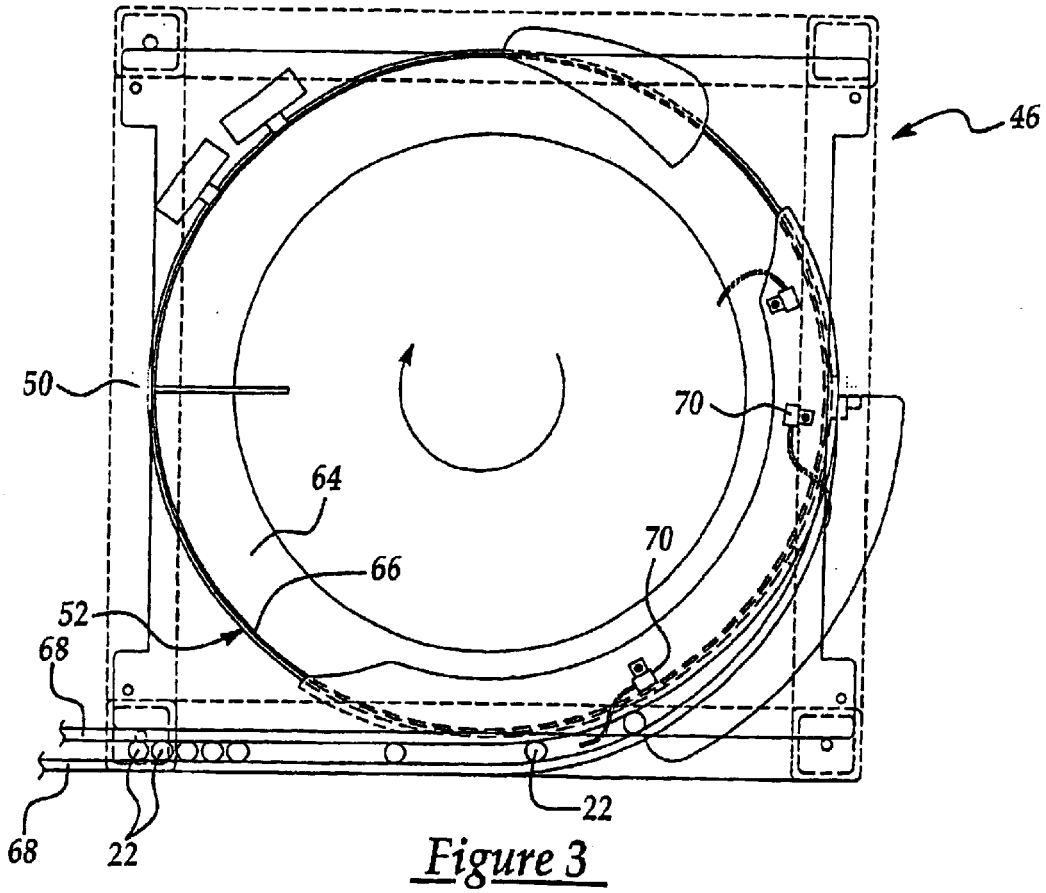
FIG. 3 is a top view of a vibratory bowl of the feeder station.
Figure 4:
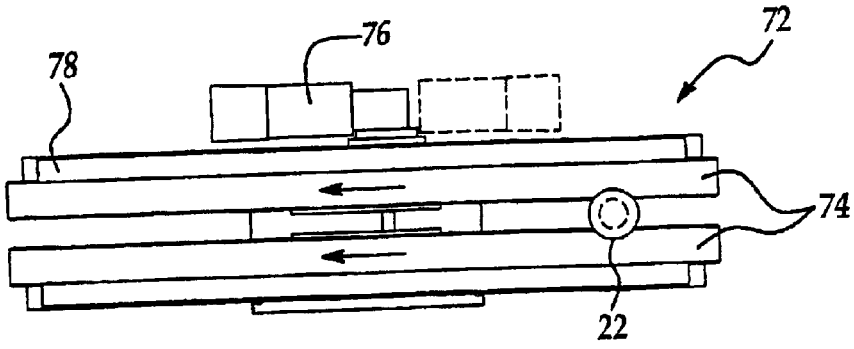
FIG. 4 is a top view of a dual belt drive system of the feeder station showing a fastener being carried upon and between two parallel conveyor belts of the dual belt drive system.
Figure 5:
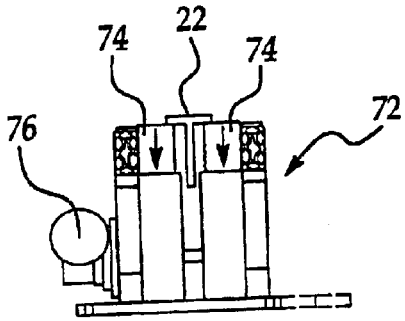
FIG. 5 is an end view of the dual belt drive system.
Figure 6:
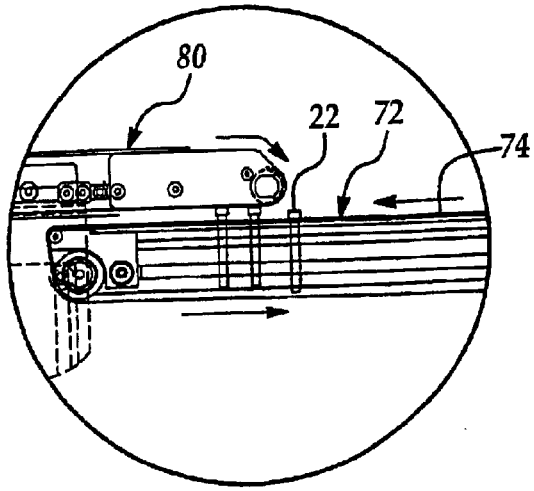
FIG. 6 is an enlarged partial side view of the sorting machine illustrating the workpiece being transferred from the dual belt drive system to a transport system.
Figure 7:
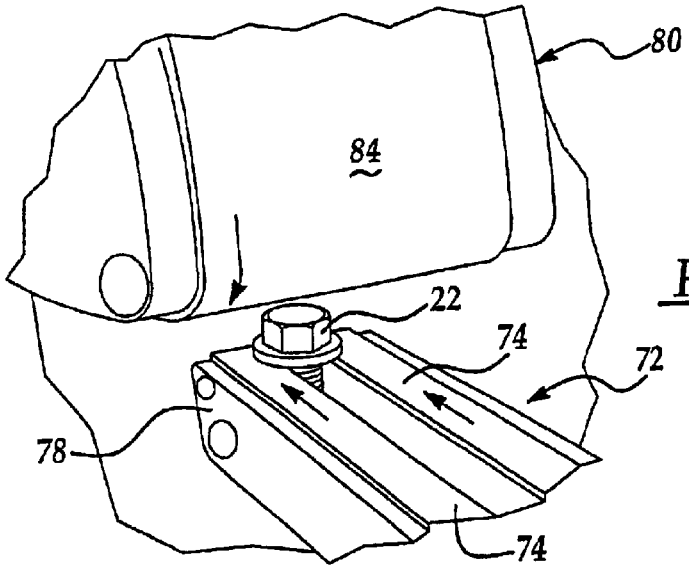
FIG. 7 is a partial perspective view of the sorting machine illustrating suspended fasteners being transferred from the top side of the dual belt drive system to the bottom side of the transport system.

Referring to FIGS. 1–3, the present invention is a sorting machine 20 of workpieces 22. The machine 20 inspects and segregates out non-conforming or defective workpieces 24 from conforming workpieces 26 which meet pre-established dimensional guidelines assuring or thus maintaining the quality of the product which is ultimately sent to the customer. The workpieces 22 are preferably metallic fasteners or any other metallic part which can be secured to a magnet and is manufactured in mass quantities. The fasteners 22 may include, for example, bolts or screws that generally have flat and enlarged head portions and unitary narrow, threaded portions. In general, once a batch of fasteners is manufactured, the fasteners within the batch are sorted so that non-conforming, malformed, or defective fasteners 24 can be removed from the batch and discarded. In this way, only the conforming, properly formed, and non-defective fasteners 26 are ultimately made available for sale to the public.

More particularly, once manufactured, the un-inspected fasteners 22 are stored within a hopper or bulk dumpster unit 28 of the sorting machine 20 and are thus staged to be fed into a fastener feed station 30 located adjacent to the hopper unit 28. The hopper unit 28 is preferably designed to vibrate, causing the fasteners 22 to loosely fall into the feed station 30. The feed station 30 orientates and aligns each fastener 22 which are then fed into an inspection station 32 via a central controller or computer 34. The inspection station 32 examines each fastener 22 for dimensional conformance and automatically discards the rejected or failed fasteners 24 into a rejected station or container 36, and transports the conforming fasteners 26 into a packaging station 38 for counting, packaging, and ultimate delivery to the customer.

The hopper unit 28 has a large hopper 40 which contains the staged fasteners 22 and a vibrating tray 42 disposed directly between an opening 44 at the bottom of the hopper 40 and a vibrating distribution or container assembly 46 of the feed station 30. Disposed below and engaged directly to the bottom of the tray 42 is a vibrating mechanism 48 which activates via a limit switch 50 that measures the level of fasteners 22 contained within a cylindrical bowl 52 of the vibrating container assembly 46. When the level of fasteners 22 contained within the bowl 52 reaches a pre-established level, the limit switch 50 causes the vibrating mechanism 48 of the tray 42 to deactivate, as best shown in FIG. 3. Without the tray vibration, the fasteners 22 cease to flow out of the hopper 40. When the level of fasteners within the bowl 52 decrease to a lower limit, the limit switch 50 re-activates the vibrating mechanism 48 to replentish the fasteners within the bowl 52 of the container assembly 46.

The vibrating container assembly 46 of the feed station 30 has at least one vibrating mechanism 54 engaged rigidly to a base 56 of the feeder station 30 and which impacts a rigid projecting member 58 of the bowl 52 at a frequency of between sixty to one hundred and twenty hertz. Preferably, there are two vibrating mechanisms 54 for each bowl 52. The bowl 52 is supported by a series of spring type supports or leaf springs 60 which extend upward from the base 56 and engage a substantially planar bottom 62 of the bowl 52. The leaf springs 60 permit limited vibratory movement of the bowl 52. The vibration of the bowl 52 causes the fasteners 22 to move upward along a spiraling shelf 64 which projects radially laterally inward from a substantially cylindrical wall 66 of the bowl 52. The fasteners or bolts 22 move via the vibration radially outward through an opening carried by the bowl wall 66 and disposed near the top of the bowl, and onto a pair of guide rails 68 secured rigidly to the exterior of the bowl wall 66. Transfer of the fasteners 22 from the shelf 64 to the guide rails 68 is also assisted by a continuous blast of compressed air emitted from a flexible tube 70 secured near the top of the bowl wall 66.

The guide rails 68 are disposed substantially tangential to the bowl wall 66 and project at an angle slightly downward therefrom. The two parallel guide rails 68 are sufficiently spaced laterally away from one another so that the longitudinal or threaded portion of the fasteners or bolts 22 extend substantially downward between the rails 68. The radial or head portion of the bolts 22 has a diameter greater in length than the width between the two rails 68. In this way, the bolts 22 do not pass downward through the rails, but are suspended from the rails 68 in a linear orderly fashion.

Referring to FIGS. 2–5, the vibration of the bowl 52 and thus the rigidly engaged rails 68, and the angle of the rails, cause the bolts 22 to move in a suspended fashion along and between the rails and onto a substantially horizontal dual belt drive system 72 of the feed station 30. Each conveyor belt 74 of the dual belt drive system 72 moves via a common variable speed motor 76 controlled by the central controller 34. A downward facing annular surface of the head of each bolt 22 rests directly upon both conveyor belts 74. The lateral distance between the belts 58 and between the substantially parallel rails 68 is adjustable to accommodate fasteners or bolts 22 of varying head and/or shank diameters.

Referring to FIGS. 6–9, slightly overlapping a distal end portion 78 of the dual belt drive system 72 is a transport system 80 of the inspection station 32. The transport system 80 is preferably of a variable speed conveyor belt type, having a longitudinal magnetic member 82 disposed substantially horizontally and radially inward from a substantially horizontal conveyor belt 84 preferably made from polyurethane. The magnetic member 82 is directly adjacent to that portion of the belt 68 which faces generally downward, yet disposed slightly above the distal end portion 78 of the dual belt drive system 72 to permit vertical clearance for the head of the bolt 22. Two screw-type height adjustors 85 are operatively engaged to the transport system 80 to adjust for this height difference to accommodate fasteners 22 having different head vertical heights.

As consecutive suspended bolts 22 near the distal end portion 78, the magnetic member 82 attracts the metallic properties of the bolt 22 through the conveyor belt 84 of the transport system 80. The frictional relationship between the belt 84 and the top of the head of the bolt 22 cause the bolt to move with the belt 68 although the magnetic member 82 is held stationary. Similar to the dual belt drive system 72, the bolts 22 are again held in a suspended fashion except now from the top of the head. The magnetic force of the member 82 is strong enough to overcome the force of gravity which would otherwise cause the bolt 22 to disengage and fall.

The magnetic member 82 is generally continuous and is composed of a series of constant and/or electromagnets 86 aligned directly adjacent to one another in a linear fashion and along the length of the conveyor belt 84 opposite the fasteners or bolts 22. The belt 84 is driven by a variable speed gear motor 87 being adjustable and controlled by the central controller 34. Increasing the speed of the conveyor belt 84 will increase the distance between fasteners 22 suspending from the belt. A minimum of one half inch fastener to fastener separation is required for reliable sorting and inspection. As the fasteners 22 travel with the belt 84 of the transport system 80 they individual pass between an emitter and a receiver light beam of a trigger sensor 88 which is preferably of a photo or infrared design which sends a signal to the controller 34 that in-turn triggers a dimensional sensing apparatus 90 disposed immediately downstream of the sensor 88. The dimensional image or signal is processed by the central controller 34. If pre-established dimensions or guidelines for the fastener 22 are not met, the fastener 22 is labeled as a nonconforming fastener 24. The controller 34 then signals a reject mechanism 92 engaged operatively to the transport system 80 immediately downstream of the dimensional sensing apparatus 90 to release or eject the nonconforming fastener 24 from the transport system 80, thus allowing the fastener 24 to fall into a reject shoot 94 which guides the nonconforming fastener into the bin 36 for recycling. The timing of the reject mechanism 92 actuation is dictated by the speed of the conveyor belt 84.

Figure 8:
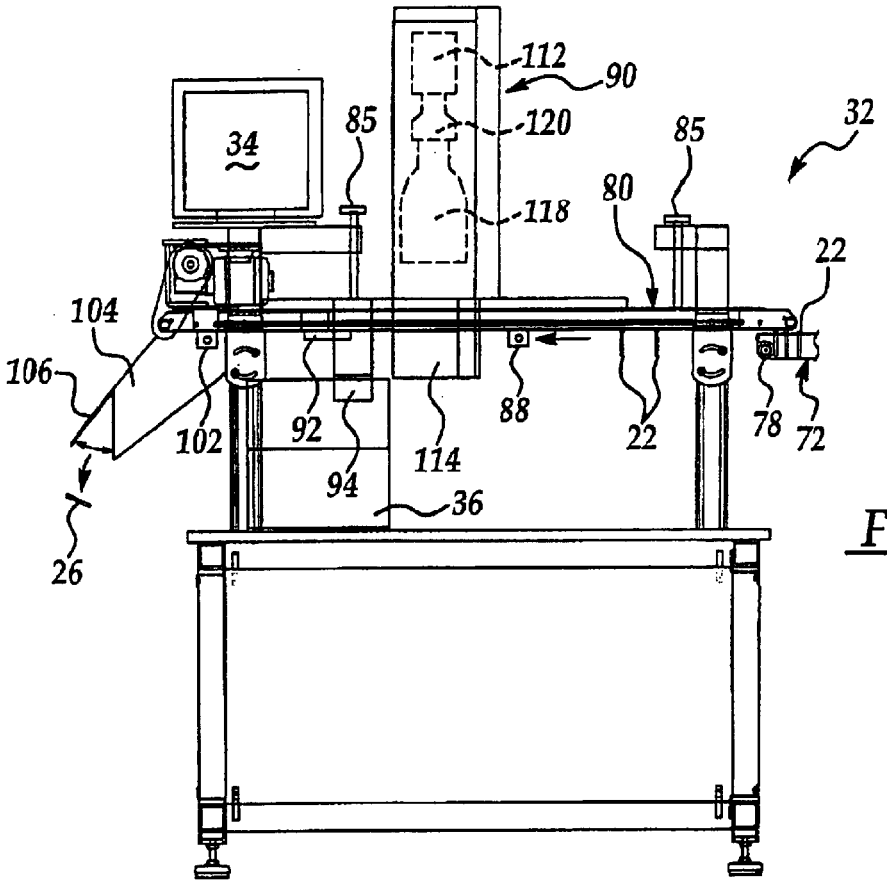
FIG. 8 is a side view of an inspection station of the sorting machine having the transport system.
Figure 9:
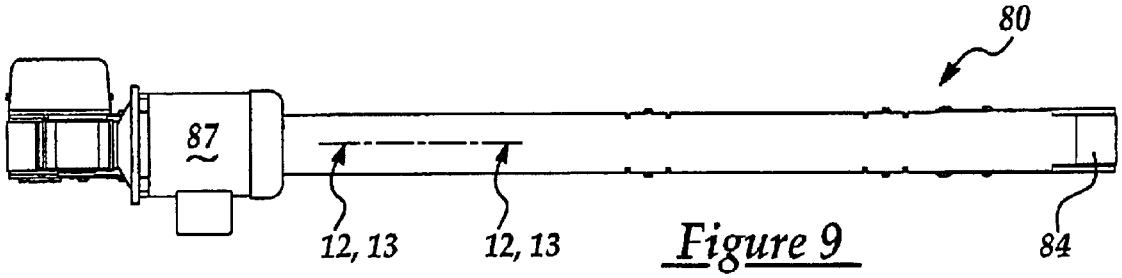
FIG. 9 is a top view of the transport system.
Figure 11:
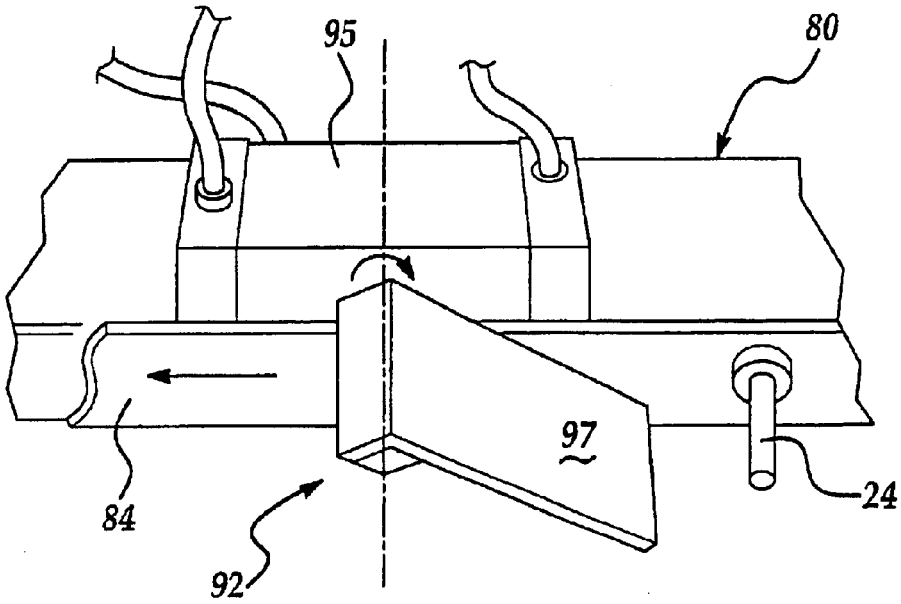
FIG. 11 is a partial perspective view of the transport system illustrating a workpiece rejection assembly.

Referring to FIGS. 8 and 11, the reject mechanism 92 is illustrated as a pivoting flipper mechanism having a rigid plate which pivots into the path of the nonconforming fastener 24 thereby physically knocking the fastener into the reject shoot 94. The magnets 86 of the member 82, located at the point where the flipper or reject mechanism 92 physically knocks off the nonconforming fasteners 22, have a magnetic strength which is slightly weaker than the magnetic strength of the remaining magnets, yet strong enough to prevent the conforming fasteners 26 from falling into the reject shoot 94. This difference in magnetic strength assists the flipper mechanism 92 in removing the nonconforming fasteners from the transport system 80.

In operation, the flipper or paddle mechanism 92 has a solenoid which is energized by the controller 34 to force air into one end of a linear actuator 95. The air forces a cylinder arm on the actuator, with a flipper paddle 97 mounted at the end at an approximate forty-five degree angle, out. The fastener 24 is then diverted off to the side of the conveyor belt 84 and into the rejection bin 36. The paddle 97 remains positioned across the conveyor belt 84 until a conforming fastener 26 is sensed by the inspection method being used. The inspection method will send an electrical signal back to the controller 34 and energize another solenoid (not shown), which will send an air blast to the opposite end of the linear actuator (not shown), which in-turn forces the arm and attached paddle 97 back into its "home" position, off to the side, parallel to the conveyor belt 84. The flipper paddle 97 will remain in its "home" position until a non-conforming fastener 24 is sensed by the inspection method in use, and the flipper mechanism 92 will once again energize.

Figure 12:
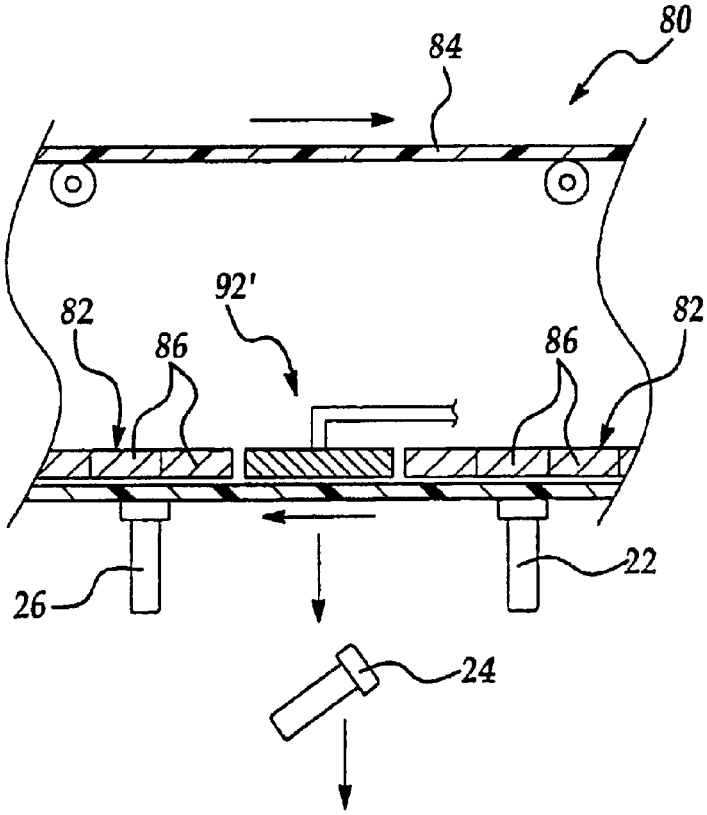
FIG. 12 is a partial longitudinal cross section of a transport system illustrating a second embodiment of a workpiece rejection assembly of a sorting machine.

Referring to FIG. 12, a second embodiment of a reject mechanism 92' is illustrated wherein the flipper of the first embodiment and the weaker magnets 86 located near the flipper are replaced with an electromagnet controlled by the controller 34. Thus, when a traveling nonconforming fastener 24 is orientated below the electromagnet reject mechanism 92', the controller de-energizes the electromagnet and the nonconforming fastener 24 falls into the reject shoot 94.

Figure 13:
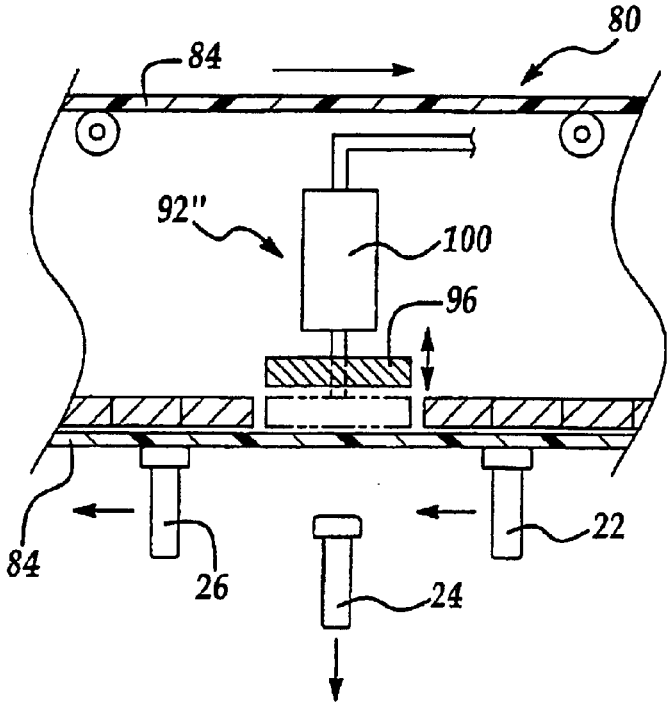
FIG. 13 is a partial longitudinal cross section of a transport system illustrating a third embodiment of a workpiece rejection assembly of a sorting machine.

Referring to FIG. 13, a third embodiment of a reject mechanism 92" is illustrated wherein the electromagnet of the second embodiment which performs the reject function is replaced with a passive or polarized magnet 96 engaged to a vertical moving rod 98 of a pneumatic or electric solenoid 100 of the reject mechanism 92". The solenoid 100 is controlled by the controller 34. Actuation of the reject mechanism 92" causes the rod 98 to retract upward into the solenoid 100 which moves the magnet 96 upward and away from the conveyor belt 84 and thus the non-conforming fastener 24. The magnetic field exposed to the targeted fastener 24 thus becomes weak enough, via spatial distance, for the nonconforming fastener 24 to fall into the shoot 36.

Referring to FIG. 8, a counter sensor 102 provides the signal sent to the controller 34 to count the passing conforming fasteners 26 while they are still secured to the belt 84 of the transport system 80 and prior to their release into a conforming fastener chute 104 engaged to the end of the transport system 80. The counter sensor 102 is mounted to the transport system 80 between the chute 104 and any one of the reject mechanisms 92, 92', 92". The conforming fasteners 26 are counted and fall into the chute 104, one by one, and through an open gate 106 engaged pivotally to the chute, and into a packaging container or box 108 of the packaging station 38. When a predetermined number of conforming fasteners 26 have fallen into the box 108, the gate 106 is closed via the controller 34, or manually by an operator, until the next box 108 is positioned under the chute 104. During this period of time that the gate 106 is closed, the transport system 80 can continue to drop conforming fasteners 26 into the closed chute 104 for a limited period of time at which point the gate 106 must be manually reopened or automatically reopened upon a permit signal indicating the next consecutive box 108 of the packaging station 38 is properly positioned below the chute 104. The counter sensor 102 is preferably of a photo or infrared sensor type.

Figure 10:
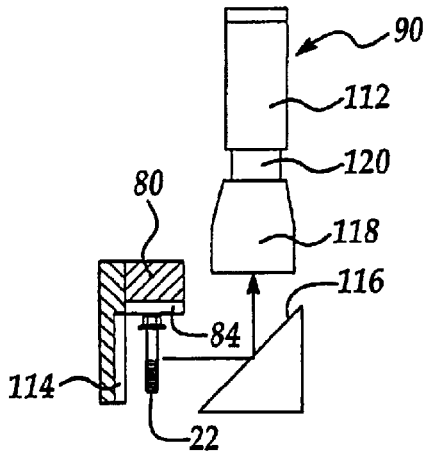
FIG. 10 is a fragmented side view of the workpiece dimensional sensing apparatus.

Referring to FIGS. 8 and 10, the dimensional sensing apparatus 90 is capable of measuring micron size dimensions and may be of a laser-type device, however, a photo or camera-type device is preferred and thus illustrated. The dimensional sensing apparatus 90 is capable of sensing a multitude of dimensions simultaneously and the controller is capable of processing the signals from the apparatus 90 all well within the time it takes any one fastener to travel from the trigger sensor 88 to the reject mechanism 92. The aperture setting and the shutter speed of a camera 112 of the sensing apparatus 90 are dictated by the surrounding light conditions and speed of the conveyor belt 94 of the transport system 80. The multitude of dimensions that the camera 112 is capable of simultaneously capturing or imaging may include for instance if the fastener 22 is a bolt the following dimensions or conditions typically known within the trade of bolt manufacturing: head diameter, flange diameter, washer diameter, head height, bearing thickness, shoulder length, shoulder diameter, dog point diameter, dog point length, shank diameter, shank angle, major thread diameter, minor thread diameter, sealant presence, thread count, washer angle, inverted washer, and length under head. If the dimensional or pre-established condition requirements are not met, the nonconforming fastener 24 can be rejected as previously described.

Referring to FIG. 10, the picture produced by the sensing apparatus 90 is established by using a planar back light 114 made up of a series of light emitting diodes which are on or energized continuously. Alternatively, a flashing back light or strobe synchronized with the traveling fastener 22 and triggered by the same trigger sensor 88 that triggers the camera 112 will also suffice. Regardless, the back light 114 is located in a substantially vertical position on one side of the transport system 80 just below the belt 84. Located on the opposite side of the transport system 80 is a mirror 116 set at an approximate angle of forty five degrees, thus being orientated to direct the light from the back light 114 upward toward a telacentric lens 118 which eliminates distortion, through a mid-lens 120 and into the camera 112 of the sensing apparatus 90. The camera 112 in conjunction with the lenses 120, 118 generate a two-sided profile of the fastener 22 passing through the sensing apparatus 90. Located in front of the mirror is a fixed piece of metal (not shown) that is in view of the camera 112. This piece of metal serves as a start point to aid in establishing part length measurement. In addition, the number of cameras and lenses used and the location of those cameras may vary based on the customer's inspection requirements.

Figure 14:
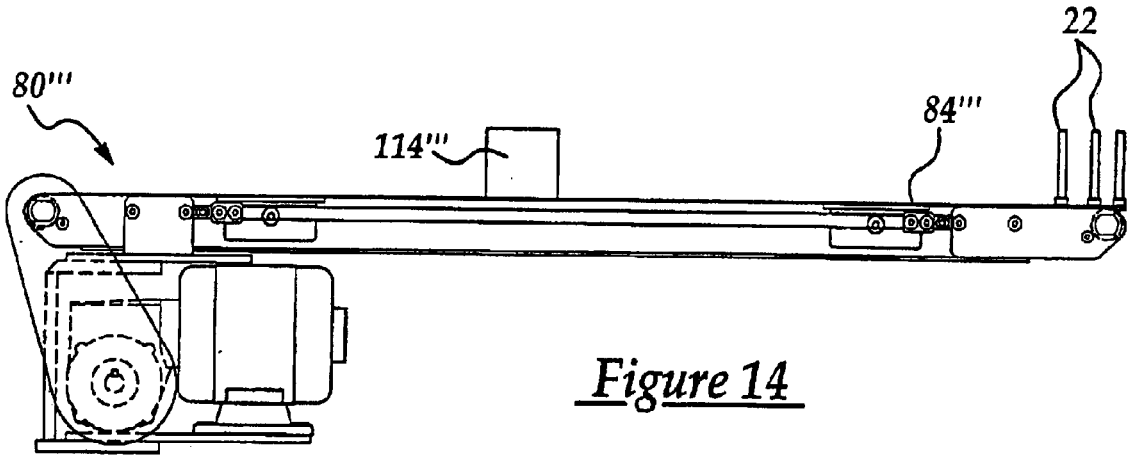
FIG. 14 is a side view of a fourth embodiment of a transport system of a sorting machine wherein the workpieces are carried on the top side of the transport system.

Referring to FIG. 14, a fourth embodiment of an inverted transport system 80'" is illustrated. The fasteners 22 are carried on the top side of a conveyor belt 84'" with their heads down resting upon the belt. In this embodiment, it is clear that the force of gravity will not assist in moving the rejected fasteners off the belt. Therefore, the preferred reject mechanism 92 is that of the flipper which physically knocks or punches the rejected fastener off the belt 84'", as previously described. A dimensional sensing apparatus, not completely shown, has a light back light 114'" disposed above the transport system 80'" instead of below as in the first embodiment. The camera (not shown) is disposed on one side of the belt and the back light 114'" is disposed opposite, on the other side of the belt. Because the dimensional sensing apparatus can be mounted substantially horizontal, the forty-five degree positioned mirror of the first embodiment is not required. The inverted transport system 80''' is useful for fastener inspection applications where the fastener has an unusual shape or is not metallic or does not react to the magnetic field of a magnet element.

Figure 15:
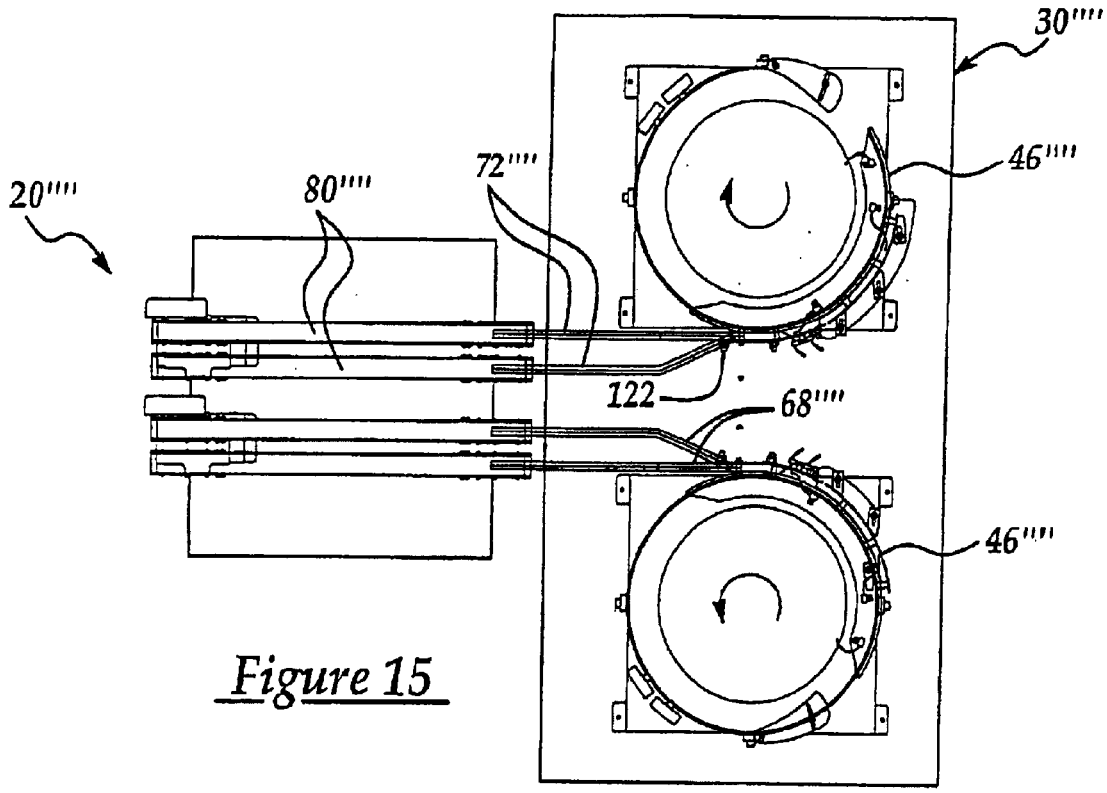
FIG. 15 is a top view of a fifth embodiment of a feeder station of a sorting machine.
Figure 16:
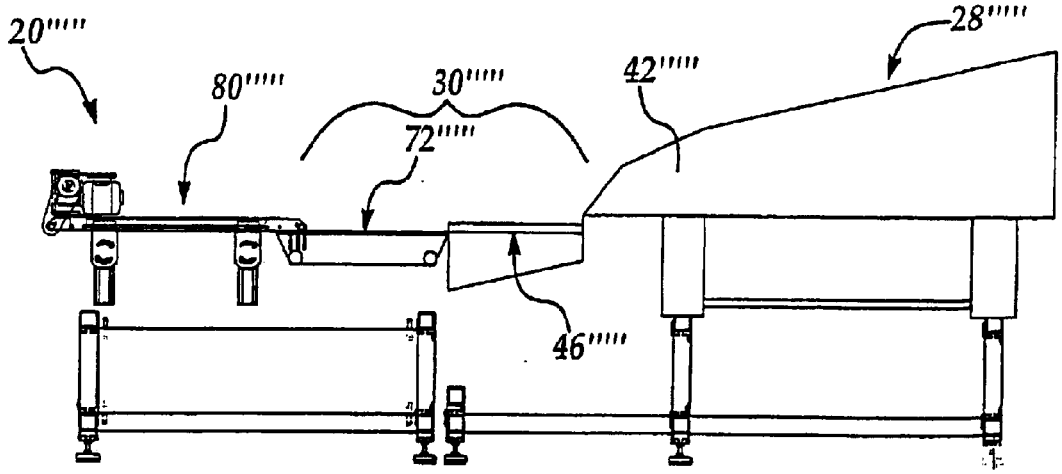
FIG. 16 is a side view of a sixth embodiment of a sorting machine.
Figure 17:
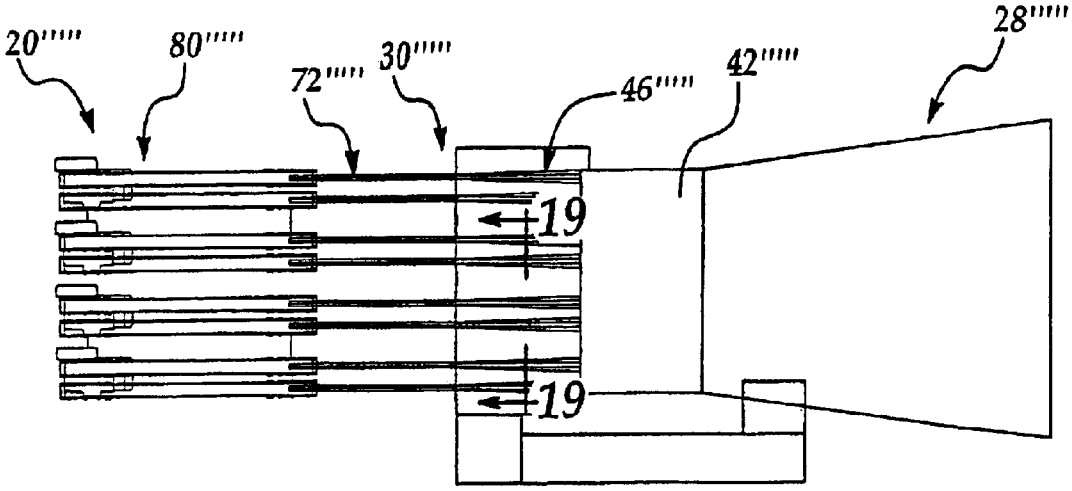
FIG. 17 is a top view of the sixth embodiment of the sorting machine.
Figure 18:
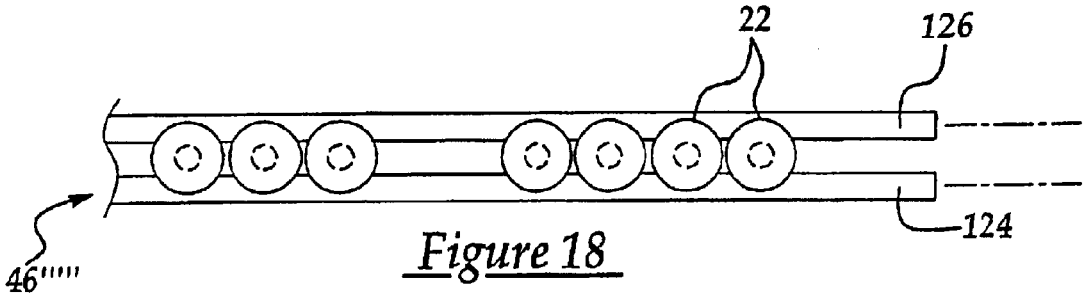
FIG. 18 is top view of a dual roller conveyor of the sixth embodiment of the sorting machine.
Figure 19:
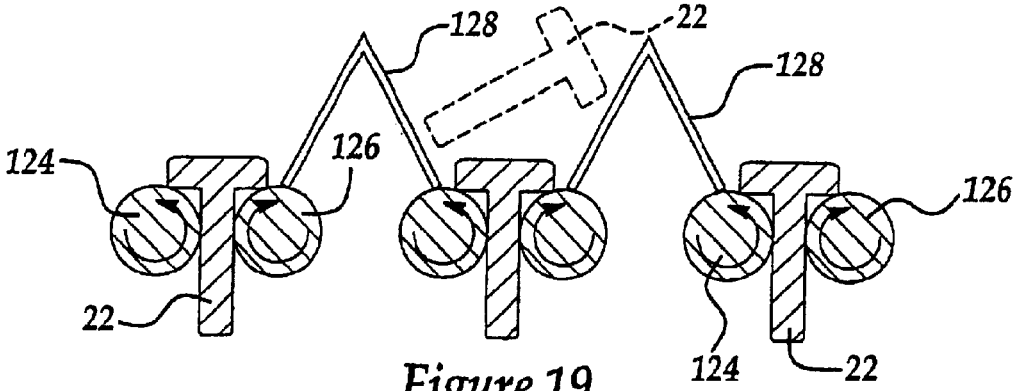
FIG. 19 is a partial cross section of the sixth embodiment of the sorting machine taken along line 19—19 of FIG. 17.

Referring to FIG. 15, a fifth embodiment of a sorting machine 20'''' is illustrated which is similar to the first embodiment except that the feeder station 30'''' has two vibrating container assemblies 46'''' and two pairs of rails 68'''' substantially tangentially extend from each container assembly 46'''' at a V-shaped junction 122 for a total of four. Each pair of rails 68'''' feed fasteners 22 into a respective dual belt drive system 72'''' which in turn feeds the fasteners 22 to a respective transport system 80''''. The sorting machine 20'''' is particularly useful where manufacturing plant floor space is scarce.

Referring to FIGS. 16–19, a sixth embodiment of a sorting machine 20''''' is illustrated. A series of roller assemblies 46''''' of a feeder station 30''''' replaces the vibrating container assembly 46 and rails 68 of the first embodiment. Each roller assembly 46''''' delivers suspended fasteners 22 to a respective dual belt drive system 72''''' which in turn feeds the suspended fasteners to a respective magnetic transport system 80'''''.

Each roller assembly 46''''' has a first elongated roller 124 and a second parallel elongated roller 126 which counter rotates in relation to the first roller 124 and is spaced laterally therefrom at a distance slightly greater than the shank or elongated portion of the fastener 22. Similar to the first embodiment, the head of the fastener rides on each roller 124, 126. The assembly 46''''' is slightly angled thus causing the fasteners 22 to move away from a vibrating tray 42''''' of a hopper unit 28''''' and toward the respective dual belt drive system 72''''''. An inverted V-shaped baffle or fastener guide plate 128 extends longitudinally between each roller assembly 46''''' to guide the fasteners 22 falling from the common or singular vibrating tray 42''''' between the counter rotating rollers 124, 126.

Although the preferred embodiments of the present invention have been disclosed, various changes and modifications may be made thereto by one skilled in the art without departing from the scope and spirit of the invention as set forth in the appended claims. It is also understood that the terms used herein are merely descriptive, rather than limiting, and that various changes may be made without departing from the scope and spirit of the invention.

What is claimed is:

1. A sorting machine for inspecting and sorting a workpiece, the sorting machine comprising:

a central controller;

a hopper unit for bulk storage of a plurality of workpieces;

a feed station having a distribution assembly and a belt drive system, wherein the plurality of workpieces loosely fall from the hopper unit into the distribution assembly and wherein the belt drive system receives the plurality of workpieces in an orderly fashion from the distribution assembly;

an inspection station having a variable speed transport system, a trigger sensor, a dimensional sensing apparatus, and a reject mechanism, wherein the transport system receives the plurality of workpieces one-by-one in a linear fashion and each respective one of the workpieces travel via the transport system past the trigger sensor which sends a signal to the controller to actuate the dimensional sensing apparatus disposed along the transport system and between the trigger sensor and the reject mechanism; and wherein the central controller receives a dimension signal from the sensing apparatus and activates the reject mechanism to remove the respective one of the plurality of workpieces from the transport system if the respective one of the plurality of workpieces is nonconforming.

2. The sorting machine set forth in claim 1 wherein the reject mechanism is a flipper mechanism having a paddle which physically knocks the nonconforming workpiece of the plurality of workpieces away from the transport system.

3. A sorting machine for inspecting and sorting a workpiece, the sorting machine comprising:

a central controller;

a hopper unit for bulk storage of a plurality of workpieces;

a feed station having a distribution assembly and a belt drive system, wherein the plurality of workpieces loosely fall from the hopper unit into the distribution assembly and wherein the belt drive system receives the plurality of workpieces in an orderly fashion from the distribution assembly;

an inspection station haying a variable speed transport system, a trigger sensor, a dimensional sensing apparatus, and a reject mechanism, wherein the transport system receives the plurality of workpieces one-by-one in a linear fashion and each respective one of the workpieces travel via the transport system past the trigger sensor which sends a signal to the controller to actuate the dimensional sensing apparatus disposed along the transport system and between the trigger sensor and the reject mechanism;

wherein the central controller receives a dimension signal from the sensing apparatus and activates the reject mechanism to remove the respective one of the plurality of workpieces from the transport system if the respective one of the plurality of workpieces is nonconforming;

each one of the plurality of workpieces having an elongated shank and a head projecting radially outward from one end of the shank;

wherein the head of each one of the plurality of workpieces is made of a ferrous material; and the transport system having an elongated conveyor belt and a magnetic member constructed and arranged to hold the ferrous head of the workpiece against the conveyor belt.

4. The sorting machine set forth in claim 3 wherein the magnetic member is stationary and is disposed radially inward from and directly adjacent to the conveyor belt of the transport system.

5. The sorting machine set forth in claim 4 wherein the magnetic member has a plurality of magnets aligned side by side in a linear fashion, and wherein the magnets located adjacent to the reject mechanism have a weaker pull strength than the remaining magnets of the plurality of magnets.

6. The sorting machine set forth in claim 3 wherein the plurality of workpieces are suspended from the conveyor belt of the transport system via the magnetic field of the magnetic member.

7. The sorting machine set forth in claim 6 wherein the dimensional sensing apparatus has a back light positioned on one lateral side of the transport system and a camera positioned on an opposite side of the transport system.

8. The sorting machine set forth in claim 6 wherein the reject mechanism is a electromagnet interposing the magnetic member, and which is de-energized by the controller to reject an adjacent nonconforming workpiece of the plurality of workpieces.

9. The sorting machine set forth in claim 6, wherein the reject mechanism has a constant magnet that interposes the magnet member and a solenoid constructed and arranged to move the constant magnet toward and away from the conveyor belt of the transport system upon initiation via the controller.

10. The sorting machine set forth in claim 6 comprising:

the belt drive system of the feeder station being a dual belt drive system having two parallel elongated conveyor belts spaced apart by a distance slightly greater than a diameter of the shank and slightly less than the diameter of the head of each one of the plurality of workpieces;

each one of the two conveyor belts of the dual belt drive system having an upward facing surface;

each head of the plurality of workpieces having a downward facing annular surface capable of resting upon both conveyor belts of the belt drive system so that the workpiece suspends from the upward facing surfaces; and wherein a distal end portion of the dual belt drive system is disposed under an end of the transport system and spaced at a distance slightly greater than a height of each head of the plurality of workpieces.

11. The sorting machine set forth in claim 10 wherein the dual belt drive system has a single variable speed motor for driving both conveyor belts of the belt drive system.

12. The sorting machine set forth in claim 10 wherein the distal end portion of the dual belt drive system is made of a non-ferrous material.

13. The sorting machine set forth in claim 6 comprising:

a base of the feed station;

the distribution assembly of the feed station being a vibrating container assembly having a bowl, a vibrating mechanism engaged rigidly to the base and constructed and arranged to impact the bowl at a vibration inducing frequency, a spiraling shelf projecting radially inward from a cylindrical wall of the bowl and extending upward from a bottom of the bowl, and a pair of parallel rails engaged rigidly to an exterior of the bowl near an upward end of the shelf;

wherein the distance between the parallel rails is substantially equal to the distance between the two belts of the dual belt drive system; and wherein vibration of the bowl causes the plurality of workpieces disposed within the bowl to move circumferentially upwardly within the bowl along the shelf and into, thus suspended by, the pair of parallel rails.

14. The sorting machine set forth in claim 6 wherein the hopper unit has a hopper which carries a lower opening, a tray disposed adjacent to the opening, and a vibration mechanism constructed and arranged to vibrate the tray inducing the plurality of workpieces disposed within the hopper to drop into the distribution assembly.

15. The sorting machine set forth in claim 14 wherein the distribution assembly of the feed station has a pair of elongated counter rotating rollers which suspend each one of the plurality of workpieces by the head.

16. The sorting machine set forth in claim 15 wherein the pair of counter rotating rollers are slightly slanted downward toward the transport system of the inspection station.

17. The sorting machine set forth in claim 16 wherein the pair of counter rotating rollers is one of a plurality of pairs of counter rotating rollers aligned side-by-side to one another and separated laterally by an inverted V-shaped guide plate for guiding the workpieces between the counter rotating rollers of each pair of the plurality of pairs of counter rotating rollers.

18. The sorting machine set forth in claim 17 wherein the plurality of workpieces fall loosely from the vibrating tray of the hopper unit into the plurality of pairs of counter rotating rollers disposed below the tray.

19. The sorting machine set forth in claim 18 comprising:

the belt drive system of the feeder station having a plurality of dual belt drive systems each having two parallel elongated conveyor belts spaced apart by a distance slightly greater than a diameter of the shank and slightly less than the diameter of the head of each one of the plurality of workpieces;

each one of the two conveyor belts of the dual belt drive system having an upward facing surface;

each head of the plurality of workpieces having a downward facing annular surface capable of resting upon both conveyor belts of the belt drive system so that the workpiece suspends from the upward facing surfaces;

wherein a distal end portion of each one of the plurality of dual belt drive systems is disposed under a respective end of each one of the plurality of transport systems and spaced at a distance slightly greater than a height of each head of the plurality of workpieces; and wherein each one of the plurality of pairs of counter rotating rollers is align to a respective one of the plurality of dual belt drive systems.

20. The sorting machine set forth in claim 3 wherein the heads of the plurality of workpieces rest upon an upward facing surface of the conveyor belt of the transport system and the shanks project upward from the heads.

* * * * *

UNITED STATES PATENT AND TRADEMARK OFFICE

CERTIFICATE OF CORRECTION

PATENT NO. : 6,787,724 B2
APPLICATION NO. : 10/226441
DATED : September 7, 2004
INVENTOR(S) : Bennett et al.

It is certified that error appears in the above-identified patent and that said Letters Patent is hereby corrected as shown below:

Column 8, Line 10, Claim 2 should read as follows:

2. A sorting machine for inspecting and sorting a workpiece, the sorting machine comprising:
a central controller; a hopper unit for bulk storage of a plurality of workpieces;
a feed station having a distribution assembly and a belt drive system, wherein the plurality of workpieces loosely fall from the hopper unit into the distribution assembly and wherein the belt drive system receives the plurality of workpieces in an orderly fashion from the distribution assembly;
an inspection station haying a variable speed transport system, a trigger sensor, a dimensional sensing apparatus, and a reject mechanism, wherein the transport system receives the plurality of workpieces one-by-one in a linear fashion and each respective one of the workpieces travel via the transport system past the trigger sensor which sends a signal to the controller to actuate the dimensional sensing apparatus disposed along the transport system and between the trigger sensor and the reject mechanism;
wherein the central controller receives a dimension signal from the sensing apparatus and activates the reject mechanism to remove the respective one of the plurality of workpieces from the transport system if the respective one of the plurality of workpieces is nonconforming; each one of the plurality of workpieces having an elongated shank and a head projecting radially outward from one end of the shank;
wherein the head of each one of the plurality of workpieces is made of a ferrous material; and the transport system having an elongated conveyor belt and a magnetic member constructed and arranged to hold the ferrous head of the workpiece against the conveyor belt.
lie."

Column 8, Line 13, Claim 3 should read as follows:

3. The sorting machine set forth in claim 2 wherein the magnetic member is stationary and is disposed radially inward from and directly adjacent to the conveyor belt of the transport system.

Column 8, Line 49, Claim 4 should read as follows:

4. The sorting machine set forth in claim 3 wherein the magnetic member has a plurality of magnets aligned side by side in a linear fashion, and wherein the magnets located adjacent to the reject mechanism have a weaker pull strength than the remaining magnets of the plurality of magnets.

UNITED STATES PATENT AND TRADEMARK OFFICE

CERTIFICATE OF CORRECTION

PATENT NO. : 6,787,724 B2
APPLICATION NO. : 10/226441
DATED : September 7, 2004
INVENTOR(S) : Bennett et al.

It is certified that error appears in the above-identified patent and that said Letters Patent is hereby corrected as shown below:

Column 8, Line 53, Claim 5 should read as follows:

5. The sorting machine set forth in claim 2 wherein the plurality of workpieces are suspended from the conveyor belt of the transport system via the magnetic field of the magnetic member.

Column 8, Line 58, Claim 6 should read as follows:

6. The sorting machine set forth in claim 5 wherein the dimensional sensing apparatus has a back light positioned on one lateral side of the transport system and a camera positioned on an opposite side of the transport system.

Column 8, Line 62, Claim 7 should read as follows:

7. The sorting machine set forth in claim 1 wherein the reject mechanism is a flipper mechanism having a paddle which physically knocks the nonconforming workpiece of the plurality of workpieces away from the transport system.

Column 8, Line 66, Claim 8 should read as follows:

8. The sorting machine set forth in claim 5 wherein the reject mechanism is a electromagnet interposing the magnetic member, and which is de-energized by the controller to reject an adjacent nonconforming workpiece of the plurality of workpieces.

Column 9, Line 4, Claim 9 should read as follows:

9. The sorting machine set forth in claim 5, wherein the reject mechanism has a constant magnet that interposes the magnet member and a solenoid constructed and arranged to move the constant magnet toward and away from the conveyor belt of the transport system upon initiation via the controller.

Column 9, Line 10, Claim 10 should read as follows:

10. The sorting machine set forth in claim 5 comprising:
the belt drive system of the feeder station being a dual belt drive system having two parallel elongated conveyor belts spaced apart by a distance slightly greater than a diameter of the shank and slightly less than the diameter of the head of each one of plurality of workpieces;

It is certified that error appears in the above-identified patent and that said Letters Patent is hereby corrected as shown below:

each one of the two conveyor belts of the dual belt drive system having an upward facing surface; each head of the plurality of workpieces having a downward facing annular surface capable of resting upon both conveyor belts of the belt drive system so that the workpiece suspends from the upward facing surfaces; and
wherein a distal end portion of the dual belt drive system is disposed under an end of the transport system and spaced at a distance slightly greater than a height of each head of the plurality of workpieces.

Column 9, Line 35, Claim 13 should read as follows:

13. The sorting machine set forth in claim 5 comprising:
a base of the feed station;
the distribution assembly of the feed station being a vibrating container assembly having a bowl, a vibrating mechanism engaged rigidly to the base and constructed and arranged to impact the bowl at a vibration inducing frequency, a spiraling shelf projecting radially inward from a cylindrical wall of the bowl and extending upward from a bottom of the bowl, and a pair of parallel rails engaged rigidly to an exterior of the bowl near an upward end of the shelf;
wherein the distance between the parallel rails is substantially equal to the distance between the two belts of the dual belt drive system; and
wherein vibration of the bowl causes the plurality of workpieces disposed within the bowl to move circumferentially upwardly within the bowl along the shelf and into, thus suspended by, the pair of parallel rails.

Column 10, Line 10, Claim 14 should read as follows:

14. The sorting machine set forth in claim 5 wherein the hopper unit has a hopper which carries a lower opening, a tray disposed adjacent to the opening, and a vibration mechanism constructed and arranged to vibrate the tray inducing the plurality of workpieces disposed within the hopper to drop into the distribution assembly.

UNITED STATES PATENT AND TRADEMARK OFFICE

CERTIFICATE OF CORRECTION

PATENT NO. : 6,787,724 B2
APPLICATION NO. : 10/226441
DATED : September 7, 2004
INVENTOR(S) : Bennett et al.

It is certified that error appears in the above-identified patent and that said Letters Patent is hereby corrected as shown below:

Column 10, Line 47, Claim 20 should read as follows:

20. The sorting machine set forth in claim 2 wherein the heads of the plurality of workpieces rest upon an upward facing surface of the conveyor belt of the transport system and the shanks project upward from the heads.

Signed and Sealed this

Sixteenth Day of December, 2008

JON W. DUDAS
*Director of the United States Patent and Trademark Office*